US009521476B2

(12) United States Patent
Spiridigliozzi

(10) Patent No.: US 9,521,476 B2
(45) Date of Patent: Dec. 13, 2016

(54) CUSTOM SOUND BOX

(71) Applicant: Shari Spiridigliozzi, Netcong, NJ (US)

(72) Inventor: Shari Spiridigliozzi, Netcong, NJ (US)

( * ) Notice: Subject to any disclaimer, the term of this patent is extended or adjusted under 35 U.S.C. 154(b) by 22 days.

(21) Appl. No.: 14/805,425

(22) Filed: Jul. 21, 2015

(65) Prior Publication Data

US 2016/0337733 A1 Nov. 17, 2016

Related U.S. Application Data

(60) Provisional application No. 62/162,017, filed on May 15, 2015.

(51) Int. Cl.
*G10F 1/06* (2006.01)
*H04R 1/02* (2006.01)

(52) U.S. Cl.
CPC .. *H04R 1/02* (2013.01); *G10F 1/06* (2013.01)

(58) Field of Classification Search
CPC ..... G10F 1/00; G10F 1/06; H04R 1/00; H04R 1/02; H04R 2201/02
See application file for complete search history.

(56) References Cited

U.S. PATENT DOCUMENTS 5,130,696 A 7/1992 Liebman
5,283,567 A 2/1994 Howes
5,387,108 A 2/1995 Crowell
5,923,242 A 7/1999 Slagle et al.
5,992,629 A 11/1999 Gullord et al.
6,298,990 B1 10/2001 Amrod et al.
6,335,691 B1 1/2002 Bird
6,393,402 B1 5/2002 Loudermilk et al.
6,538,186 B1 * 3/2003 Huang ..... G10F 1/06 84/453

(Continued)

FOREIGN PATENT DOCUMENTS

DE 29721971 U1 4/1999

OTHER PUBLICATIONS

WIPO International Searching Authority, Notification of Transmittal of the International Search Report and the Written Opinion of the International Searching Authority, or the Declaration, for PCT counterpart (PCT/US2015/042198) of US application, received Dec. 15, 2015.

(Continued)

*Primary Examiner* — Thang Tran
(74) *Attorney, Agent, or Firm* — Benjamin Appelbaum

(57) ABSTRACT

A sound box comprises a cover assembly, interior box assembly, compartment assembly, sound module assembly and frame assembly. The interior box assembly includes a receptacle for holding an item. A light-activated sound module contained within the frame in inside a compartment attached to the cover assembly top. The sound module comprises a sound chip, light sensor, speaker and power source in electrical communication. A flap containing a magnetic closure interacts magnetically with an interior box wall to close the sound box. The box is opened by lifting a flap and raising the top, allowing light to enter the light sensor after entering an opening in a compartment containing the sound module, causing the sound module to play back the sound recorded thereon. The sound can range from animal and/or environmental sounds, music, congratulatory messages, other types of voice recordings, bells, whistles and the like.

20 Claims, 10 Drawing Sheets

(56) References Cited

U.S. PATENT DOCUMENTS

| | | | | |
|---|---|---|---|---|
| 7,837,038 | B2 | 11/2010 | Chang et al. | |
| 8,309,831 | B2 * | 11/2012 | Timm | G10F 1/06 84/95.1 |
| 8,448,360 | B2 | 5/2013 | Guo et al. | |
| 8,448,361 | B2 | 5/2013 | Sapp et al. | |
| 8,549,776 | B2 | 10/2013 | Guo et al. | |
| 8,720,690 | B2 | 5/2014 | Ruggiero | |
| 2001/0011495 | A1 | 8/2001 | Song | |
| 2002/0096448 | A1 | 7/2002 | Lee | |
| 2009/0237243 | A1 | 9/2009 | Child et al. | |
| 2012/0031255 | A1 | 2/2012 | Stites | |
| 2014/0008265 | A1 | 1/2014 | Ruggiero | |
| 2014/0311936 | A1 | 10/2014 | Marks | |

OTHER PUBLICATIONS

WIPO, International Searching Authority,International Search Report, for PCT/US2015/042198, PCT counterpart of US application, received Dec. 15, 2015.

WIPO, International Searching Authority, Written Opinion of the International Searching Authority, for PCT/US2015/042198, PCT counterpart of U.S. application, received Dec. 15, 2015.

* cited by examiner

CUSTOM SOUND BOX

CROSS-REFERENCE TO RELATED APPLICATION

This application claims the benefit of U.S. Provisional Application for Patent, Ser. No. 62/162017, filed 15 May 2015, by the present inventor, and whose contents are incorporated by referenced herein in their entirety.

FIELD OF THE INVENTION

Embodiments of the present invention relate to a sound box for containing items, and contains a light-activated sound module that plays a recorded sound when the box is opened. The sound can be any sound selected by the producer of the sound box, and can range from animal and/or environmental sounds, music, congratulatory messages, other types of voice recordings, bells, whistles and the like.

BACKGROUND OF THE INVENTION

In recent years, greeting cards have been sold that contain sound modules which can play back a recorded sound when the card is opened. Often, the recorded sound is a message such as "Happy Birthday", "Happy Anniversary", or other type of congratulatory message. More recently, the card manufacturers have sold cards in which the purchaser can make their own recording onto the card for playback of a personalized message when the recipient opens the card.

Manufacturers have started placing sound modules into other products, for example, to hold gift items or promotional items, such that when the package containing the item is opened, the sound played back may announce that the user has won something, plays a congratulatory message, or other sounds to attract the attention of others to the recipient to promote the manufacturer's product.

Embodiments of the present invention comprise a cover assembly (forming the top, top flap, side and bottom), an interior box assembly (having an interior receptacle for holding an item), a compartment assembly, and a sound module assembly containing a light-activated sound module attached to the inside of the box. The sound module comprises a sound chip, light sensor, speaker and power source that are electrically interconnected. The sound can range from animal and/or environmental sounds, music, congratulatory messages, other types of voice recordings, bells, whistles and the like, and can be played for up to 30 seconds. When the box is opened by lifting a flap, the top is raised, allowing light to strike the light sensor after entering an opening in a compartment containing the sound module, causing the sound module to play back the sound recorded thereon. Magnetic closures in the top flap interact with metal in the interior box wall to close the sound box.

BRIEF SUMMARY OF THE INVENTION

An object of the present invention is to provide a sound box in which the recorded sound can be customized to the requirements of the user.

Another object of the present invention is to provide a sound box in which a light-activated sensor will cause a sound module to play back a recorded sound when the box is opened and light strikes the light sensor.

Embodiments of the present invention provide a sound box that comprises several assemblies, and when the sound box is closed, form a light-tight seal. These assemblies include a cover assembly, an interior box assembly, a sound module assembly and a compartment assembly.

An embodiment of a sound box comprises a cover assembly, interior box assembly, compartment assembly, sound module assembly and frame assembly. The interior box assembly includes a receptacle for holding an item. A light-activated sound module is contained within the frame inside a compartment attached to the cover assembly top. The sound module comprises a sound chip, light sensor, speaker and power source in electrical communication. A flap containing a magnetic closure interacts magnetically with an interior box wall to close the sound box. The box is opened by lifting a flap and raising the top, allowing light to enter the light sensor after entering an opening in the compartment containing the sound module, causing the sound module to play back the sound recorded thereon. The sound can range from animal and/or environmental sounds, music, congratulatory messages, other types of voice recordings, bells, whistles and the like.

DETAILED DESCRIPTION OF THE INVENTION

Figure 1:
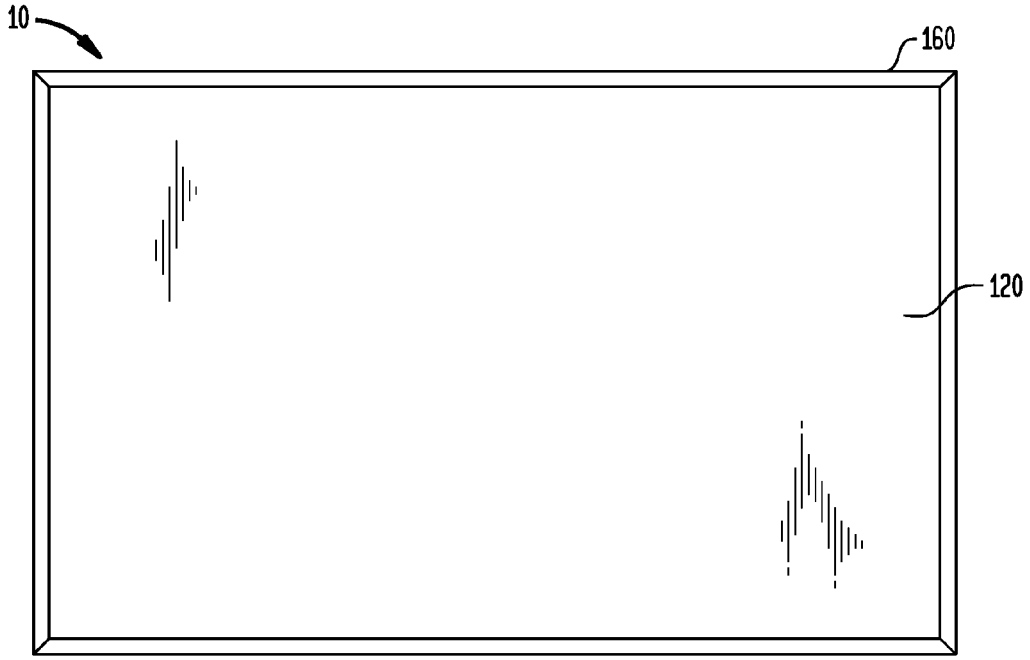
FIG. 1 is a top plan view of an embodiment of the present invention.

An embodiment of the custom sound box, reference numeral 10, is shown in FIG. 1. The sound box 10 comprises a top 120, bottom 140 and sidewall 160. The top contains an inner surface 122 and outer surface 124; the bottom includes a lower surface 142 and an upper surface 144, the top 120 and bottom 140 being interconnected by sidewall 160.

The custom sound box 10 is manufactured from several assemblies, each of which will be described below. These assemblies are the cover assembly 100 (which forms the top, sidewall and bottom of the sound box), the interior box assembly 200, the compartment assembly 300 and the sound module assembly 400.

Figure 2:
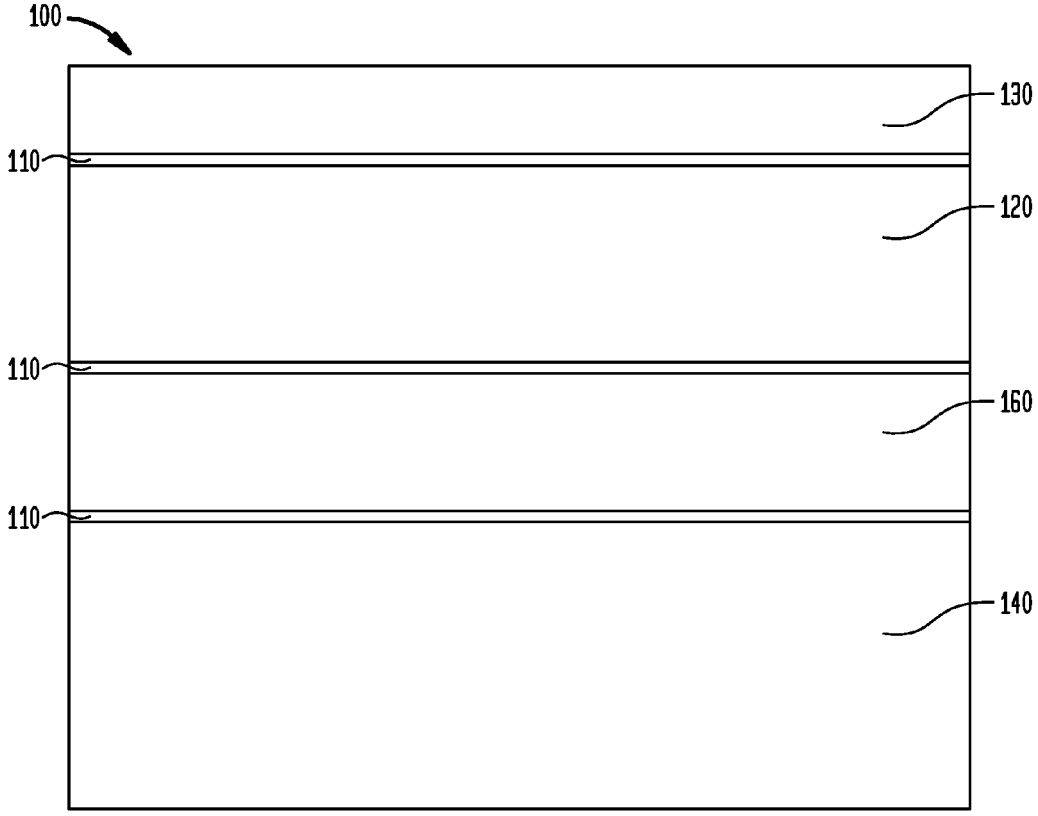
FIG. 2 is a plan view of the cover assembly.

The cover assembly 100 comprises a single sheet of material 100, with the material having several foldlines 110 that are demarcation points for which section will become the top 120, top flap 130, bottom 140 and the sidewall 160 (FIG. 2). In alternate embodiments, the top, bottom and sidewall could be made from individual and/or multiple pieces rather than from a single sheet of material, and could also be made from a combination of materials.

Figure 3:
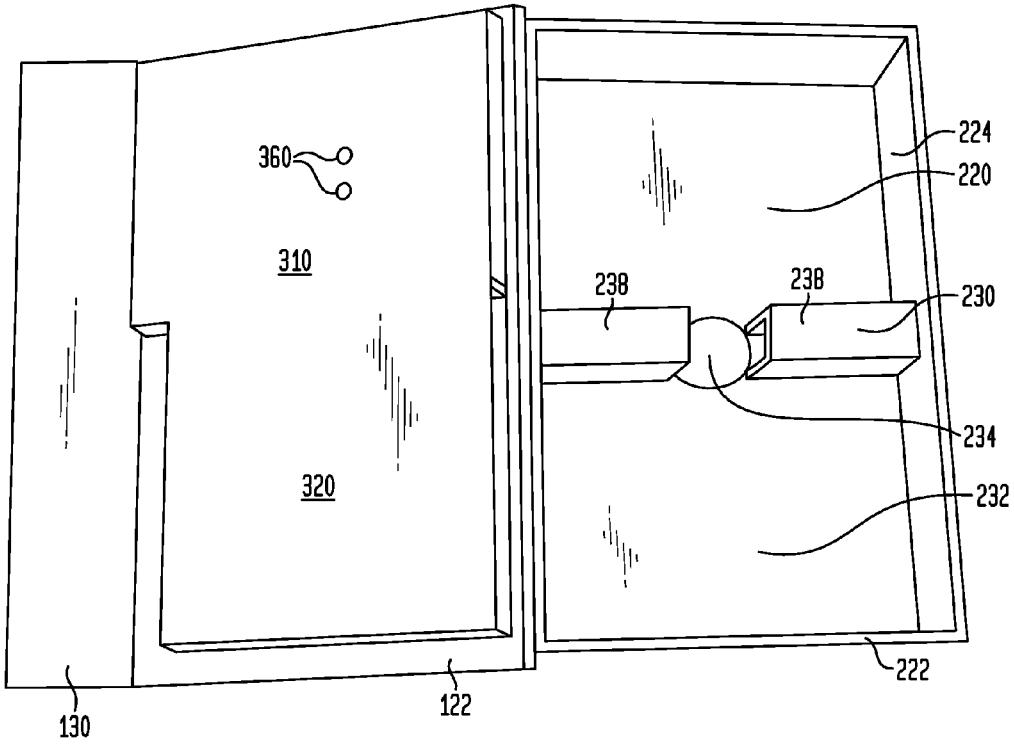
FIG. 3 shows the embodiment of FIG. 1 in the open position.
Figure 4:
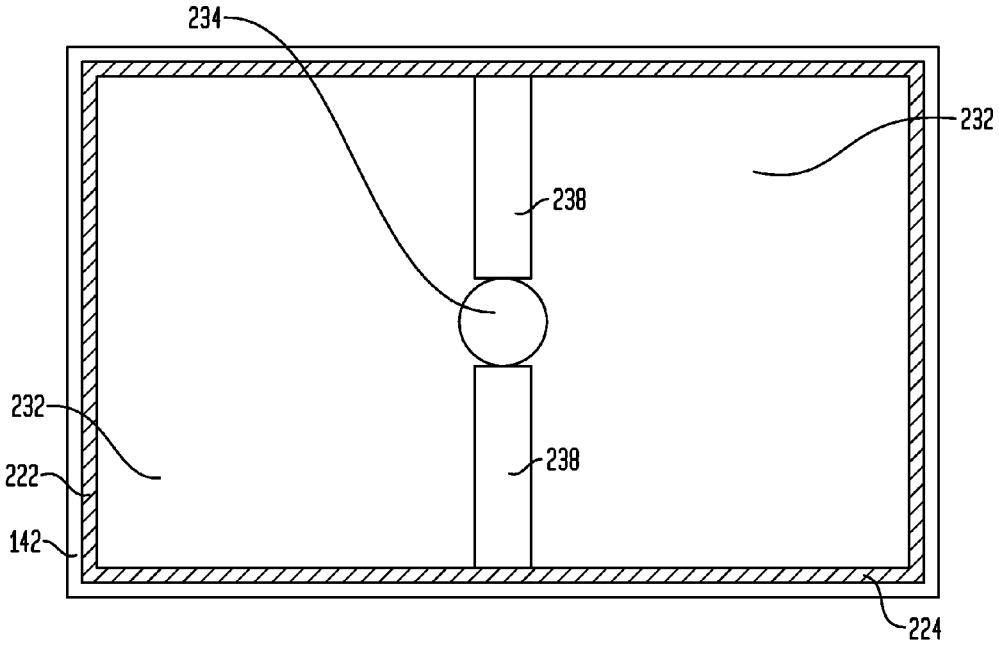
FIG. 4 is a plan view of the interior box.

The interior box assembly 200 comprises a base 220 and box walls 222 and 224. Base 220 is attached to upper surface 144 and a box wall 224 is attached to sidewall 160 (see FIG. 3). The box wall 224 that is opposite the box wall attached to the sidewall 160 includes one or more pieces of metal 236 (shown in phantom) that will interact with a magnetic closure 132. An interior wall 230 divides interior box assembly 200 into two receptacles 232. As shown in the drawing, the interior wall 230 is not continuous, and includes a gap 234 that separates the interior wall into two interior walls 238. The gap 234 is of a size sufficient for a user to insert a finger into the interior box assembly 200, reach therein and remove the contents of either or both receptacles 232. In the embodiment shown, the receptacles 232 are sized to contain an item such as a deck of playing cards, a gift card, or other items. In one embodiment, the dimensions of the sound box are about 6.5 inches long by about 4 inches wide by about 1.5 inches high. In other embodiments (not shown) the size of the custom sound box could be varied to hold smaller items, or increased to contain larger items or a combination of small and large items.

Figure 5:
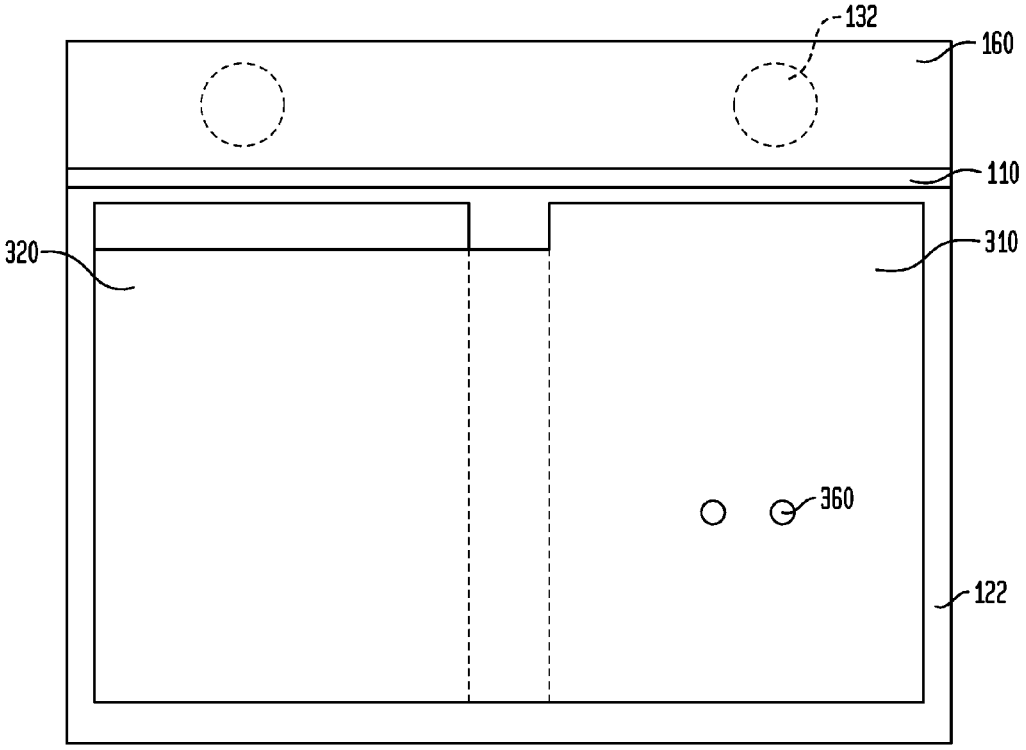
FIG. 5 is a plan view of the bottom side of the sound box top.
Figure 6:
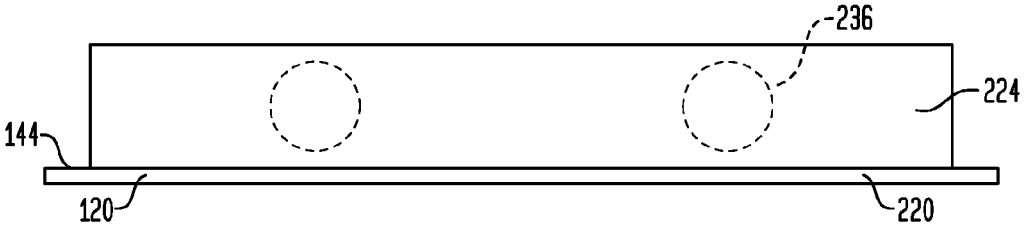
FIG. 6 is a side view of the interior box shown in FIG. 4.

FIG. 5 is a plan view of the bottom side of the sound box top 122. Sound box top 120 extends to a fold point 118 beyond which fold point the top terminates in a flap 130. Flap 130 includes magnetic closures 132 (shown in phantom), the magnetic closure being a magnet. A piece of metal 134 that generally corresponds to the shape of the magnet 132 is contained within box wall 224 and which, when being contacted by the flap 130, closes the sound box 10 so that light does not enter the sound box 10 until the sound box is opened.

In the embodiment shown, the magnet 132 and metallic piece 236 are circular and generally the same size to ensure a good fit, but other shapes and sizes of both the magnets and the metallic strips can be utilized in other embodiments. Different types of closures can be utilized in other embodiments, such as snaps, hook and loop fasteners, a tab that slides into the bottom, a hasp, a zipper, a repositionable adhesive, and the like.

Figure 7:
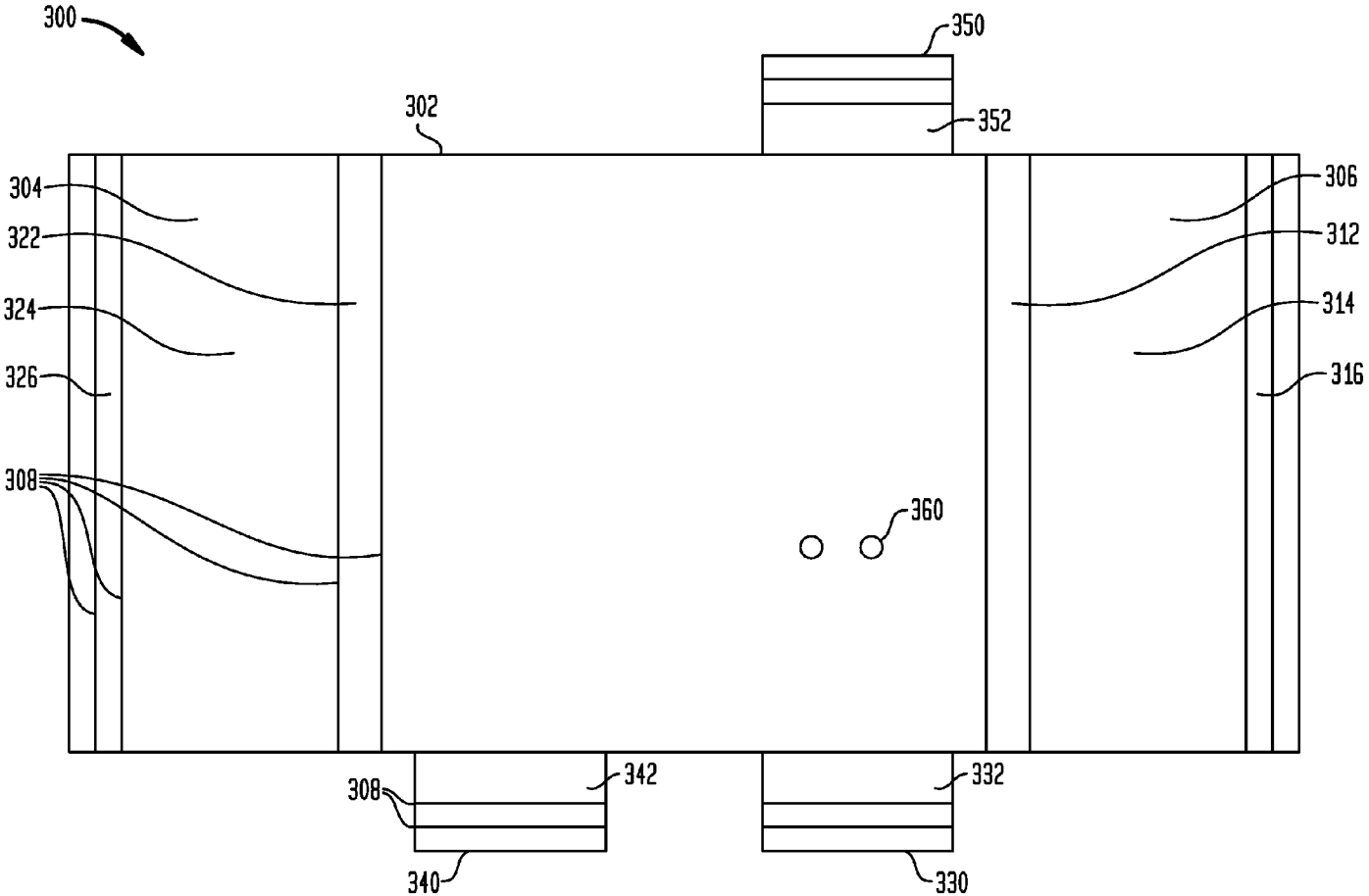
FIG. 7 Is a plan view showing the compartment assembly.
Figure 8A:
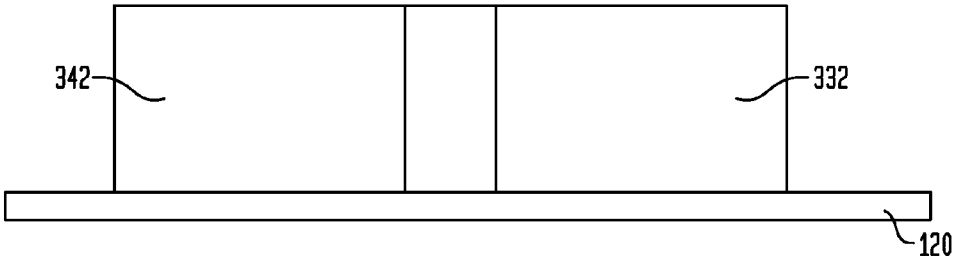
FIG. 8A is a side view of the compartment assembly attached to the sound box top.
Figure 8B:
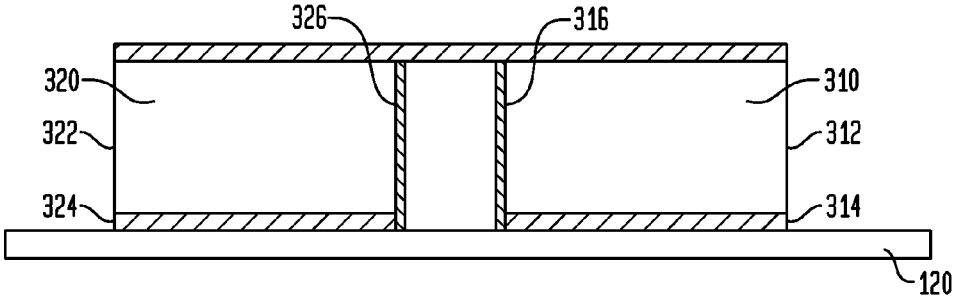
FIG. 8B is a cross-section of the compartment assembly shown in FIG. 8A.
Figure 9:
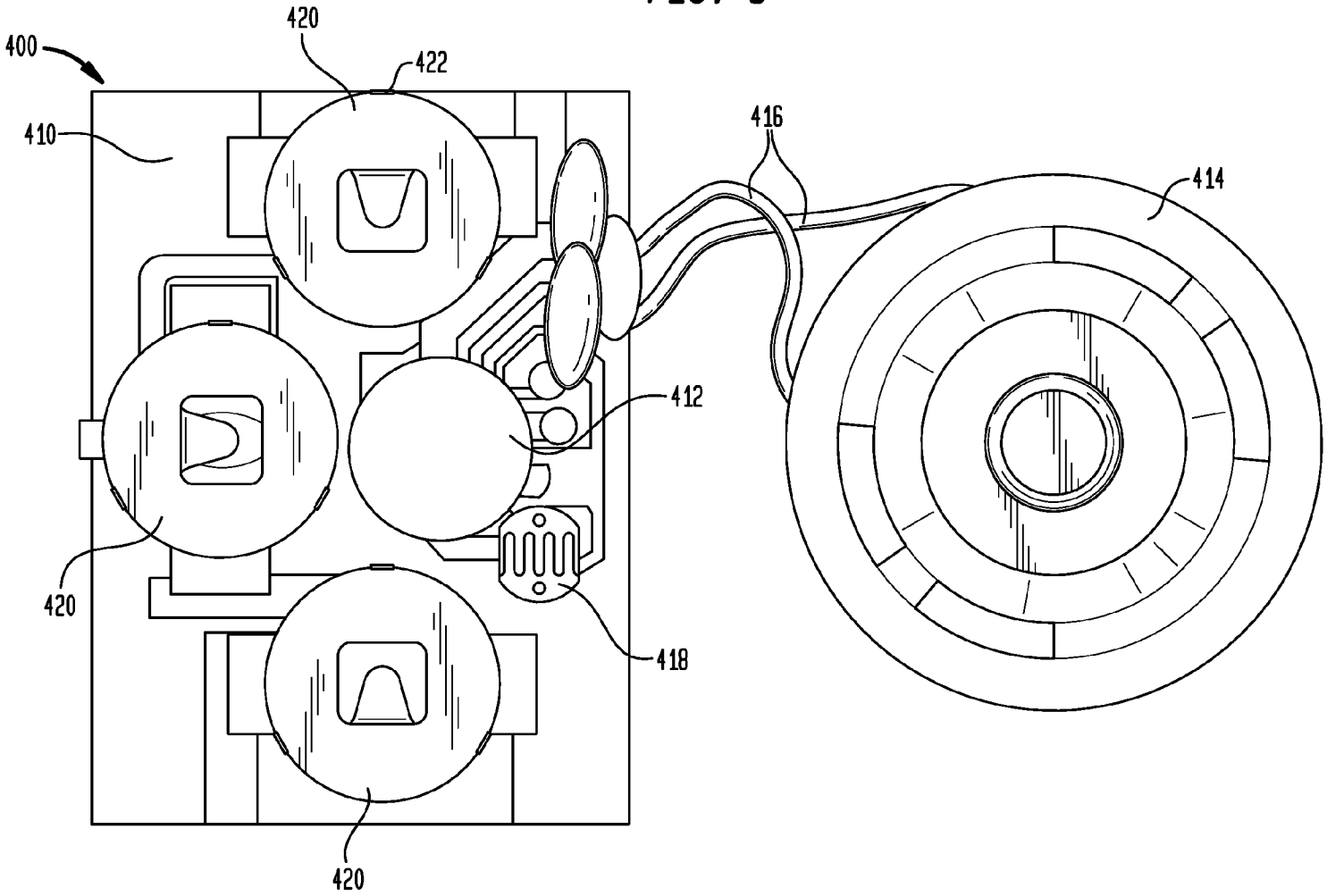
FIG. 9 illustrates the sound module of the embodiment shown in FIG. 1.
Figure 10:
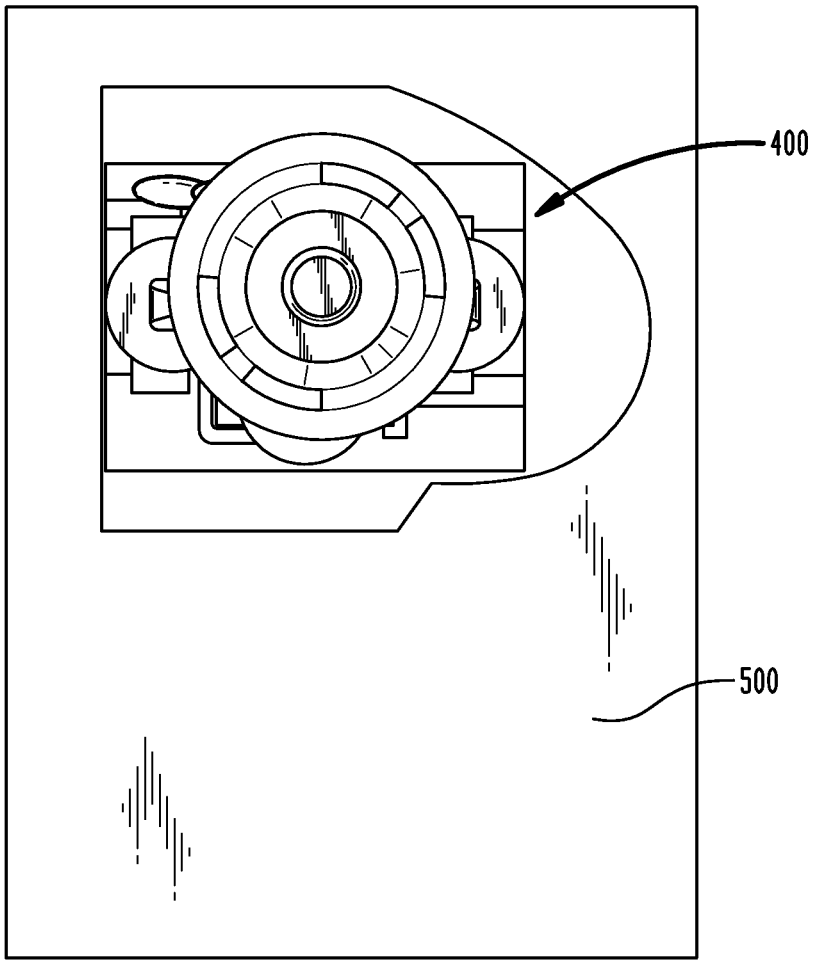
FIG. 10 shows the sound module of FIG. 9 within a frame prior to insertion in the embodiment of FIG. 1.

The compartment assembly 300 is generally formed from a single sheet of material 302 (FIGS. 7-8), whose ends 304 and 306 are folded so that two compartments 310 and 320, are formed. The reference numeral 308 represent fold points where the material 302 is folded. Reference numerals 312, 314, and 316, and 322, 324 and 326 refer to the first side, bottom and second side, of compartments 310 and 320, respectively. The compartment assembly 300 is attached to the sound box top by adhesive, applied to the compartment bottoms 314 and 324.

Tabs 330 and 340 are folded to form an end wall 332 and 342 of compartment 310 and 320, respectively. Another tab 350 is folded over and serves as a closure 352 at the other end of first compartment 310. One or more openings 360 are formed in first compartment 310 to allow light to enter the light sensor 416 and allow sound from the speaker 414 to be heard; the sound module 400 will be contained within the first compartment 310.

The two compartments 310 and 320 are attached to the box top inner surface 122. The second compartment 132 is not closed; it usually remains empty. In an alternate embodiment the second compartment 132 could be closed by a flap.

The sound module 400 comprises a printed circuit board 410 on which an integrated circuit chip/sound chip 412, a speaker 414, wiring 416, a light sensor 418, and a power source 420, comprising one or more batteries 420, are all electrically interconnected. The batteries 420 are retained by mounting clips 422. The mounting clips 422 can be positioned so that the batteries can be permanently attached to the circuit board 410, or can be removed and replaced by the user.

In the embodiment shown, the sound chip 412 can make a recording of up to 30 seconds in length. In other embodiments, sound chips that have different recording times, such as 60 seconds, 100 seconds, 200 seconds or 300 seconds can be utilized. The sound recorded can range from animal and/or environmental sounds, music, congratulatory messages, other types of voice recordings, bells, whistles and the like, generally being limited by the imagination of the individual preparing the recording. Some examples of sounds that may be played, not intended to be limitations, include a baby's cry, a cat's meow, a dog's bark, "Happy Birthday", "Happy Anniversary", "Congratulations", a lion's roar, and a wolf's howl. Sound chips having different time periods for recording could also be utilized. The sound module 400 is prepared using commercially available components. A desired sound is recorded onto the sound chip 412 by conventional methods of programming sound chips, as known to those skilled in the art. In alternate embodiments, a sound chip that can be recorded by the user, utilizing either a microphone, or having a connection to an audio device, such as a tape recorder, music player, audio-video player, tablet computer, smartphone device or the like, could be utilized in place of the factory-programmed sound chip 412 shown in the drawings.

One or more alternative power sources 420, could also be provided, either as a substitute for, or supplement to, the batteries 420. These alternative power sources could include a solar cell, an adapter to power the sound module 400 from a vehicle such as an automobile, or an adapter to power the sound module 400 using a conventional source of electricity appropriate to the country in which the sound box is being used, such as alternating current ("AC") in North America.

The sound module 400 can be positioned within sound box 10 by any means of attachment, such as an adhesive, double-faced tape, a fastener, hook and loop fastener, a retaining clip, a retaining pin, a snap, or other means of attachment. In the embodiment shown in the drawings, the sound module 400 is placed within the cutout 510 of a frame 500, which can comprise a piece of corrugated material, and the frame 500 containing the sound module 400 is positioned within compartment 310 so that the light sensor 416 in the sound module is in alignment with an opening 312 in the surface of the compartment 310 facing the inside of sound box 10. The frame could be chosen from any suitable type of material, ranging from paper, paperboard, cardboard, fabrics, metals, foams such as urethanes or styrofoam, plastics, or the like, depending upon the manufacturer's requirements.

The sound box 10 can be manufactured from one or more of any suitable material, ranging from, for example only and not intended as any limitation, paper, paperboard, cardboard, corrugated cardboard, kraft paper, plastic or metal, which can be formed into the appropriate configuration. Materials can be selected so that the sound box 10 may appear to have a more "finished" appearance, such as a smooth glossy finish, a textured finish, adornment by indicia or other decorations, and the like. Similarly, a liner (not shown), such as a fabric such as velvet, silk or satin, for example, could be placed in either or both of the bottom compartment, and the inside surface of the top, depending upon the ultimate use of the sound box. Some exemplary uses of the custom sound box 10 of the present invention can include as an advertising or promotional item, gift box, utility box, tool box or other packaging use.

The custom sound box 10 is manufactured from several assemblies, each of which has been previously described. The cover assembly 100 is attached to the interior box assembly 200, attaching the box bottom to the upper side of the sound box bottom, then attaching the sidewall 160 to a box wall 224 side that is the side that does not contain the metal pieces that are part of the closure mechanism. The compartment assembly 300 is attached to the inside surface of the sound box top y adhesive or other conventional attachment means.

The sound module 400 is placed into frame 500, the assembled sound module is inserted into the first compartment 310, and positioned therein to align the light sensor 416 and speaker 414 with the openings 332 in the first compartment. The sound module 400 is held in place by adhesive, as has been previously described. When assembled and the sound box closed by bringing flap 160 over to interact with the box wall 224 containing the metal pieces, the sound box is closed by means of a magnetic closure, and a light tight seal is formed.

When the flap 160 is lifted and the sound box top separated from the interior box, light strikes the light sensor 416 after entering through the opening 332 in the first compartment 310, causing the sound module to play back the sounds recorded on the sound module 400.

In an alternative embodiment, the sound box could be produced without the compartment assembly 300, and the sound module 400 and frame assembly 500 attached to the inside surface of the sound box top, or the sound module 400 itself, without the frame assembly attached to the inside surface 122 of the sound box top.

Although embodiments of this invention have been described with a certain degree of particularity, it is to be understood that the present disclosure has been made only by the way of illustration, and that numerous changes in construction and arrangement of parts may be resorted to without departing from the spirit and scope of the invention.

I claim:

1. A sound box comprising:

a cover assembly; the cover assembly comprising a sheet of material having an inner surface and an outer surface, and a plurality of foldlines to fold the cover assembly into a top, a top flap, a sidewall, and a bottom of the sound box;

an interior box assembly; the interior box assembly comprising a base; and a plurality of box walls;

a first box wall being attached to the inner surface of the sidewall; a pair of second box walls attached to the first box wall, and a third box wall opposite the first box wall and attached to the second box walls to form the interior box;

the interior box further comprising an interior wall dividing the interior box into two receptacles, the interior wall further comprising a gap therein; and the base is attached to the inner surface of the bottom;

a compartment assembly, the compartment assembly comprising a sheet of material having an inner surface and an outer surface, the compartment assembly being folded into one or more compartments and one or more tabs;

the compartment assembly being attached to the sound box top inner surface; and an opening contained within the first compartment of the one or more compartments, the opening allowing light to enter a light sensor inside the first compartment;

a sound module assembly, the sound module assembly comprising:

a printed circuit board;

an integrated circuit comprising a controller and a sound chip;

a speaker;

a light sensor; and a power source, the printed circuit board, the sound chip, the speaker, the light sensor and the power source in electrical communication, and the sound module assembly retained within a frame assembly, and the frame assembly positioned within the first compartment, the light sensor being aligned proximate the first compartment opening, wherein when the top flap is lifted to open the sound box to light, light enters the light sensor, causing the sound chip to play a sound recorded thereon.

2. The sound box as described in claim 1, wherein the top flap further comprises a magnetic closure.

3. The sound box as described in claim 2, wherein the third box wall comprises a piece of metal, the piece of metal for magnetic interaction with the magnetic closure.

4. The sound box as described in claim 2, wherein the first compartment wall further comprises a second opening, and wherein the speaker is positioned proximate the second opening.

5. The sound box as described in claim 2, wherein an end of the second compartment of the one or more compartments proximate the top flap is closed by the tab.

6. The sound box as described in claim 2, wherein an end of the second compartment of the one or more compartments proximate the sidewall is closed by the tab.

7. The sound box as described in claim 1, wherein the interior wall is divided into two interior walls, the two interior walls being separated from each other.

8. The sound box as described in claim 2, wherein the recorded sound is chosen from the group consisting of a baby's cry, a cat's meow, a dog's bark, "Happy Birthday", "Happy Anniversary", "Congratulations", a lion's roar, and a wolf's howl.

9. The sound box as described in claim 2, wherein the one or more compartments are received within the interior box when the sound box top is closed.

10. The sound box as described in claim 2, wherein the top flap has a length that covers the length of the interior box side.

11. A sound box comprising:

a cover assembly; the cover assembly comprising a sheet of material having an inner surface and an outer surface, and a plurality of foldlines to fold the cover assembly into a top, a top flap, a sidewall, and a bottom of the sound box;

the top flap further comprising a means for closing the sound box, the means for closing being a magnetic closure;

an interior box assembly; the interior box assembly comprising a base; and a plurality of box walls, the box walls being attached to each other to form a box structure, the box walls being attached to the base to form the interior box;

wherein a first box wall is attached to the inner surface of the sidewall, a third box wall is opposite the first box wall, the third box wall further comprising a metal piece that magnetically interacts with the magnetic closure;

the interior box further comprising an interior wall dividing the interior box into two receptacles, the interior wall further having a gap therein; and the base is attached to the inner surface of the bottom;

a compartment assembly, the compartment assembly comprising a sheet of material having an inner surface and an outer surface, the compartment assembly being folded into one or more compartments and one or more tabs;

the compartment assembly being attached to the sound box top inner surface; and an opening contained within the first compartment of the one or more compartments, the opening allowing light to enter a light sensor inside the first compartment;

a sound module assembly, the sound module assembly comprising:

a printed circuit board;

an integrated circuit comprising a controller and a sound chip;

a speaker;

a light sensor; and a power source; the printed circuit board, the sound chip, the speaker, the light sensor and the power source in electrical communication, the sound module assembly retained within a frame assembly, and the frame assembly positioned within the first compartment, the light sensor being aligned proximate the first compartment opening, wherein when the top flap is lifted to open the sound box to light, light enters the light sensor, causing the sound chip to play a sound recorded thereon.

12. The sound box as described in claim 11, wherein the first compartment wall further comprises a second opening, and wherein the speaker is positioned proximate the second opening.

13. The sound box as described in claim 12, wherein an end of the second compartment of the one or more compartments proximate the top flap is closed by the tab.

14. The sound box as described in claim 12, wherein an end of the second compartment of the one or more compartments proximate the sidewall is closed by the tab.

15. The sound box as described in claim 12, wherein the interior wall is divided into two interior walls, the two interior walls being separated.

16. The sound box as described in claim 12, wherein the recorded sound is chosen from the group consisting of a baby's cry, a cat's meow, a dog's bark, "Happy Birthday", "Happy Anniversary", "Congratulations", a lion's roar, and a wolfs howl.

17. A method for assembling a sound box, the method comprising the steps of:

preparing a cover assembly from a sheet of material having an inner surface and an outer surface, and a plurality of foldlines, by folding the sheet of material into a top, a top flap having a magnetic closure, a sidewall, and a bottom of the sound box;

forming an interior box assembly from a base and a plurality of box walls; by attaching the box walls to each other to form a box structure;

attaching the box structure to the base to form the interior box;

dividing the interior box into more than one receptacle by placing an interior wall in the interior box, the interior wall further having a gap therein;

attaching a first box wall to the inner surface of the sidewall, a third box wall being opposite the first box wall, the third box wall further comprising a metal piece that magnetically interacts with the magnetic closure; and attaching the base to the inner surface of the bottom;

preparing one or more compartments from a compartment assembly, the compartment assembly comprising a sheet of material having an inner surface and an outer surface, the compartment assembly being folded into one or more compartments and one or more tabs, the first compartment of the one or more compartments having an opening therein, the opening allowing light to enter the first compartment;

attaching the one or more compartments to the sound box top inner surface; and placing a sound module assembly into a frame assembly, wherein the sound module assembly comprises:

a printed circuit board;

an integrated circuit comprising a controller and a sound chip;

a speaker;

a light sensor; and a power source, the printed circuit board, the sound chip, the microphone, the speaker, the light sensor and the power source in electrical communication; and positioning the frame assembly within the first compartment, wherein the light sensor is aligned proximate the first compartment opening.

18. The method of assembling a sound box as described in claim 17, further comprising the step of recording a sound on the sound chip.

19. The method of assembling a sound box as described in claim 18, wherein the recorded sound is chosen from the group consisting of a baby's cry, a cat's meow, a dog's bark, "Happy Birthday", "Happy Anniversary", "Congratulations", a lion's roar, and a wolf's howl.

20. The method of assembling a sound box as described in claim 18, further comprising the step of attaching the sound module to the box top interior surface.

* * * * *